US009097393B2

(12) United States Patent
Huang

(10) Patent No.: US 9,097,393 B2
(45) Date of Patent: Aug. 4, 2015

(54) LED BASED LAMP ASSEMBLY

(75) Inventor: Yaote Huang, Morrisville, NC (US)

(73) Assignee: Cree, Inc., Durham, NC (US)

( * ) Notice: Subject to any disclaimer, the term of this patent is extended or adjusted under 35 U.S.C. 154(b) by 287 days.

(21) Appl. No.: 13/601,166

(22) Filed: Aug. 31, 2012

(65) Prior Publication Data

US 2014/0063809 A1 Mar. 6, 2014

(51) Int. Cl.

| | |
|---|---|
| ***F21V 29/00*** | (2006.01) |
| ***F21K 99/00*** | (2010.01) |
| ***F21V 29/77*** | (2015.01) |
| *F21V 5/04* | (2006.01) |
| *F21V 7/00* | (2006.01) |
| *F21V 17/16* | (2006.01) |
| *F21V 19/00* | (2006.01) |
| *F21V 23/00* | (2015.01) |
| *F21Y 101/02* | (2006.01) |
| *F21V 29/87* | (2015.01) |
| *F21V 29/89* | (2015.01) |

(52) U.S. Cl.

CPC ..... *F21K 9/1355* (2013.01); *F21V 29/773* (2015.01); *F21V 5/04* (2013.01); *F21V 7/0091* (2013.01); *F21V 17/164* (2013.01); *F21V 19/0035* (2013.01); *F21V 23/006* (2013.01); *F21V 29/87* (2015.01); *F21V 29/89* (2015.01); *F21Y 2101/02* (2013.01); *Y10T 29/49002* (2015.01); *Y10T 29/49117* (2015.01)

(58) Field of Classification Search

CPC ... F21K 9/1355; F21V 17/164; F21V 19/001; F21V 19/005; F21V 19/0035; F21V 29/2206; F21V 29/2231; F21V 29/225; F21V 29/246; F21V 23/006; F21V 5/04

USPC ..... 362/218, 294, 373

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

OTHER PUBLICATIONS

U.S. Appl. No. 13/462,388, filed May 2, 2012.

(Continued)

*Primary Examiner* — Y M Lee

(74) *Attorney, Agent, or Firm* — Dennis J. Williamson; Moore & Van Allen PLLC

(57) ABSTRACT

An LED device such as a lamp or light comprises an LED for emitting light and electronics for powering the LED. An enclosure retains at least a portion of the electronics. A heat sink for dissipating heat from the LED assembly is provided where a portion of the heat sink clamps the enclosure to secure the heat sink structure to the enclosure.

22 Claims, 13 Drawing Sheets

(56) References Cited

U.S. PATENT DOCUMENTS

| | | | |
|---|---|---|---|
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,449,154 | B2 | 5/2013 | Uemoto et al. |
| 8,502,468 | B2 | 8/2013 | Li et al. |
| 8,575,826 | B1 * | 11/2013 | Huang ..... 362/294 |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 2004/0201990 | A1 | 10/2004 | Meyer |
| 2009/0184618 | A1 | 7/2009 | Hakata et al. |
| 2009/0189169 | A1 * | 7/2009 | Wei ..... 257/98 |
| 2010/0103675 | A1 * | 4/2010 | Yu et al. ..... 362/294 |
| 2012/0040585 | A1 | 2/2012 | Huang |
| 2012/0170262 | A1 * | 7/2012 | Hoetzl et al. ..... 362/227 |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | WO 2011029724 | A1 * | 3/2011 |
| WO | 2012011279 | A1 | 1/2012 |
| WO | 2012031533 | A1 | 3/2012 |

OTHER PUBLICATIONS

U.S. Appl. No. 12/775,842, filed May 7, 2010.
U.S. Appl. No. 13/192,755, filed Jul. 28, 2011.
U.S. Appl. No. 13/339,974, filed Dec. 29, 2011.
U.S. Appl. No. 13/235,103, filed Sep. 16, 2011.
U.S. Appl. No. 13/360,145, filed Jan. 27, 2012.
U.S. Appl. No. 13/338,095, filed Dec. 27, 2011.
U.S. Appl. No. 13/388,076, filed Jul. 7, 2012.
U.S. Appl. No. 13/405,891, filed Feb. 27, 2012.
Cree, Inc., Chinese Application No. 2013103894622, Office Action, Jan. 26, 2015.

* cited by examiner

LED BASED LAMP ASSEMBLY

BACKGROUND

Light emitting diode (LED) lighting systems are becoming prevalent as replacements for older lighting systems and are used in many other applications. LED systems are an example of solid state lighting (SSL) and have advantages over traditional lighting solutions, such as incandescent and fluorescent lighting, because they use less energy, are more durable, operate longer, and generally contain no lead or mercury. A solid-state lighting system may take the form of a lighting unit, light fixture, light bulb, or a lamp. An LED lighting system may include, for example, a packaged light emitting device including one or more light emitting diodes (LEDs), which may include inorganic LEDs, which may include semiconductor layers forming p-n junctions and/or organic LEDs, which may include organic light emission layers.

SUMMARY

In one embodiment, an LED device comprises an LED for emitting light and electronics for powering the LED. An enclosure retains at least a portion of the electronics. A heat sink for dissipating heat from the LED where a portion of the heat sink is in direct engagement with the enclosure to secure the heat sink structure to the enclosure.

A lens may be supported on the heat sink to receive the light. The portion of the heat sink may be bent into engagement with the enclosure. The portion of the heat sink may engage a flange formed on the enclosure. The flange may extend outwardly from a wall of the enclosure. The wall of the enclosure may engage a wall of the heat sink. The portion of the heat sink may engage a first surface of the flange where the first surface of the flange may extend at an oblique angle relative to the wall of the enclosure. The heat sink may abut a second surface of the flange. The heat sink may comprise fins where the fins clamp the enclosure to secure the heat sink structure to the enclosure. The fins may be bent into engagement with the enclosure. A surface of the flange may extend at an oblique angle relative to the wall where the fins engage the surface. The fins may define a cavity for receiving the LED. The LED may be retained in the cavity by a retaining member that is connected to the fins.

In one embodiment, an LED device comprises an LED for emitting light, and electronics for powering the LED. An enclosure retains at least a portion of the electronics. A heat sink for dissipating heat from the LED where a portion of the heat sink clamps the enclosure to secure the heat sink structure to the enclosure.

In one embodiment, a method of making a lamp comprises providing an LED for emitting light; supporting the LED on a heat sink; providing electronics for powering the LED; supporting at least a portion of the electronics in an enclosure; and deforming a portion of the heat sink to clamp the enclosure to secure the heat sink to the enclosure.

The step of deforming may comprise bending the portion of the heat sink into engagement with the enclosure. The enclosure may comprise a flange formed on an outer surface of the enclosure, the portion of the heat sink engaging the flange. The step of deforming may comprise bending a plurality of fins of the heat sink into engagement with the enclosure. The step of deforming may comprise bending a plurality of fins of the heat sink into engagement with the enclosure in a single operation. The step of deforming may comprise bending a plurality of fins of the heat sink into engagement with the enclosure using a press jig. A connector may be secured to the enclosure.

DETAILED DESCRIPTION

Figure 1:
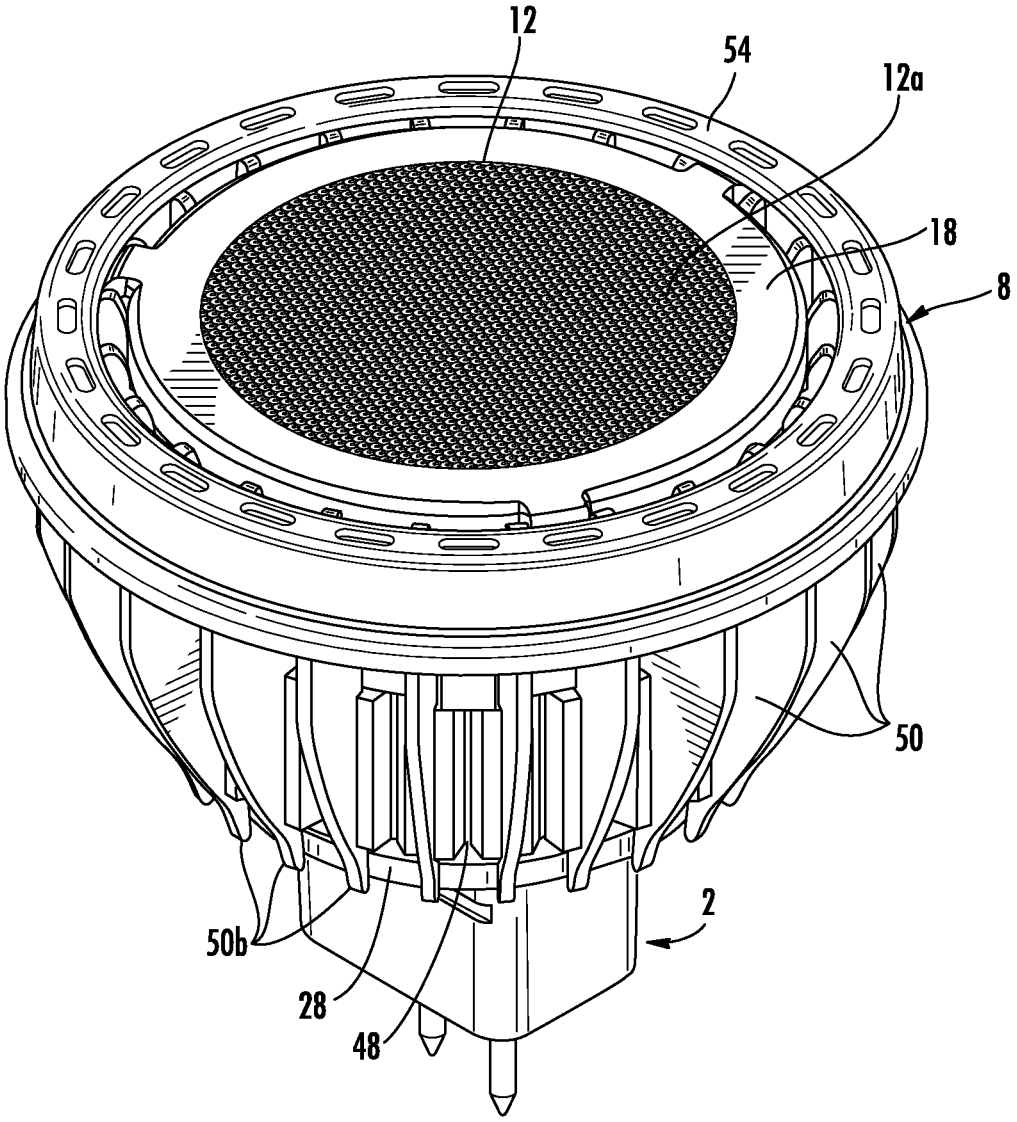
FIG. 1 is a perspective view of an embodiment of a lamp of the invention.
Figure 2:
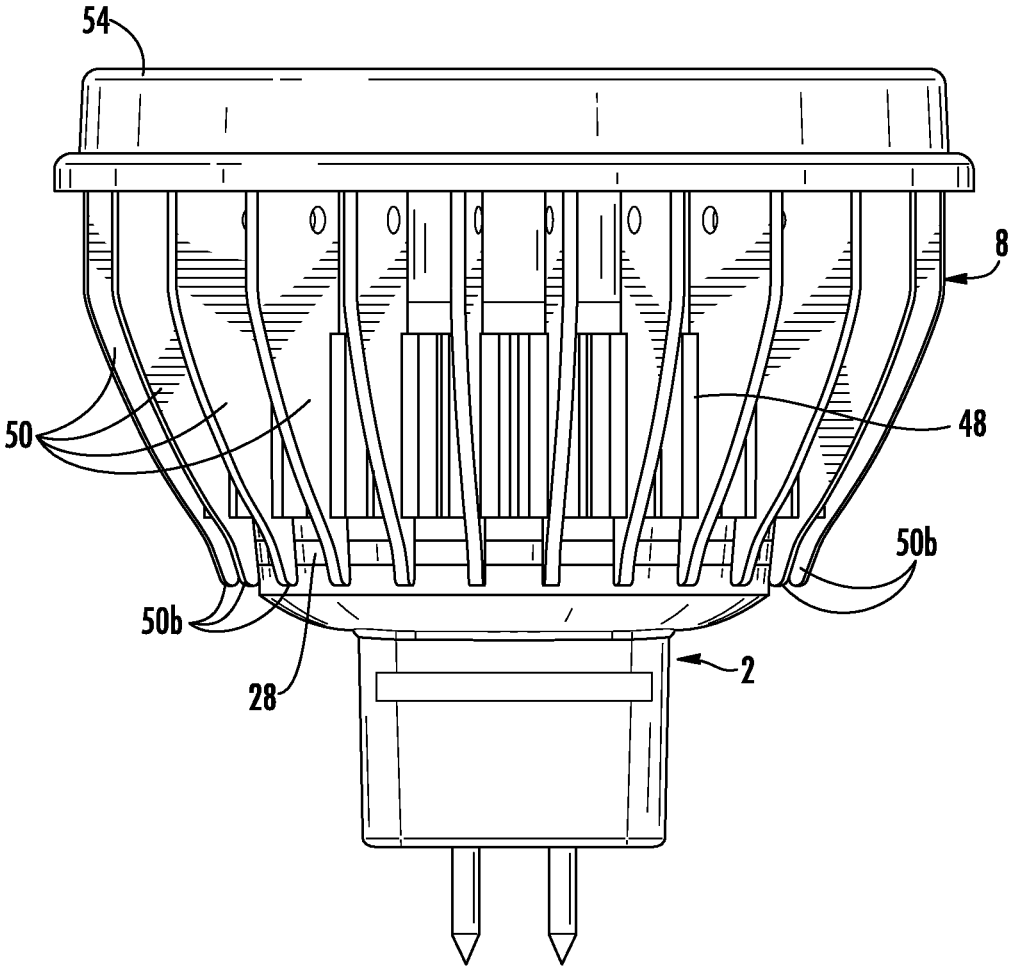
FIG. 2 is a side view of the lamp of FIG. 1.
Figure 3:
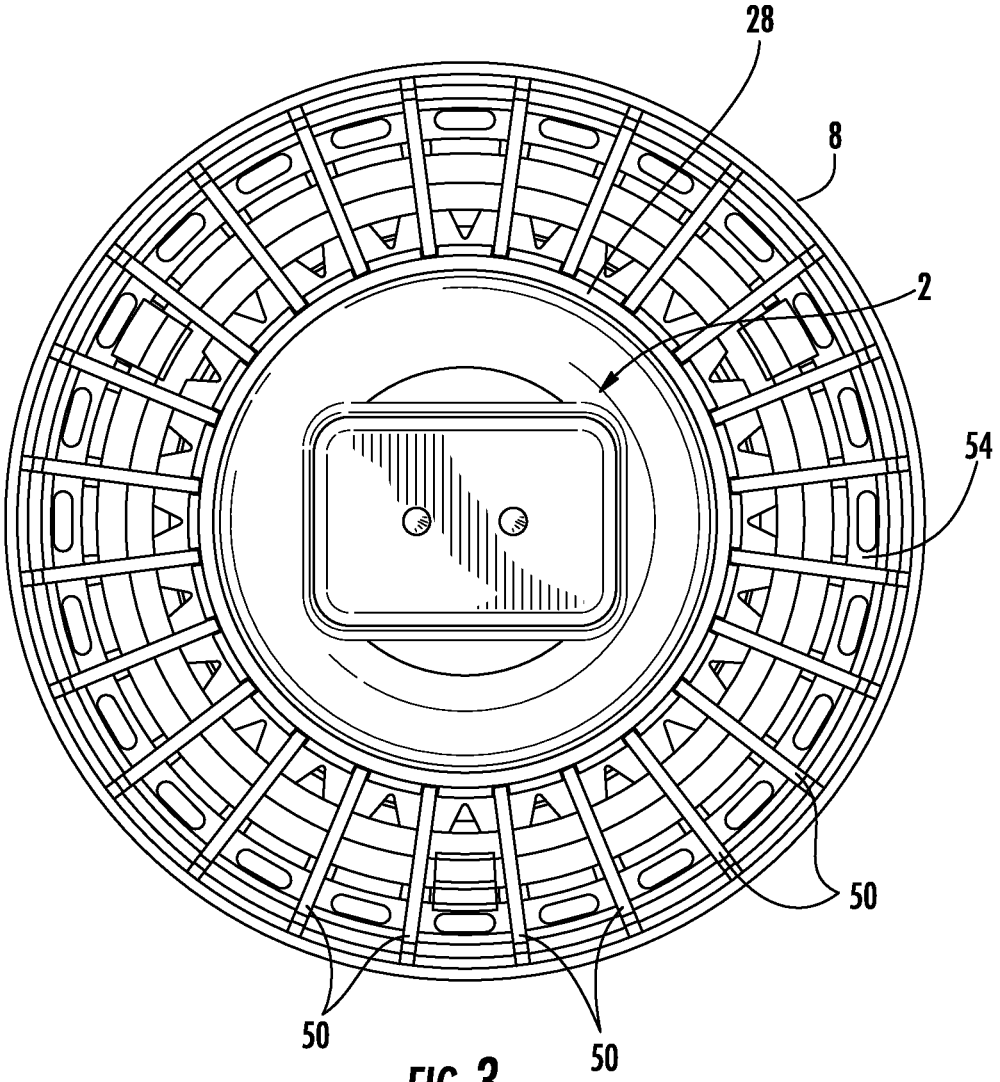
FIG. 3 is a bottom view of the lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter and may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state light emitter produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device to produce light of virtually any color including white or near white. LEDs and/or LED packages used with embodiments of the invention can include light emitting diode chips that emit hues of light that, when mixed, are perceived in combination as various colors of light including white light.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Referring to FIGS. 1 through 4 and 7, in one embodiment, the lamp comprises an electronics enclosure 2 made of a relatively rigid material such as plastic or the like. In one embodiment, the material comprises an electrically insulating and thermally conductive material. The enclosure 2 may be made of a resin or plastic with a metal filler. Such materials, once molded, may be extremely rigid such that the material is not suitable to create snap fit connections because it cannot be easily deformed. In existing lamps the lamp components, such as the enclosure and heat sink, are connected to one another by separate attachment mechanisms such as fasteners (e.g. screws) or adhesive. The use of separate attachment mechanisms increases the cost and complexity of the lamp assembly and increases manufacturing time, cost and complexity.

The electronics enclosure 2 comprises a generally hollow housing defining an internal space for receiving the lamp electronics 4. In one embodiment, the enclosure 2 has a generally open first end 6 that receives the electronics 4 and that couples to the heat sink 8 and LED assembly 10. The remainder of the enclosure 2 is substantially closed to protect the lamp electronics 4. The enclosure 2 may also comprise a pair of apertures 20 for receiving the pins 22 of the lamp electronics 4 such that the pins 22 extend externally of the enclosure 2 where they may be connected to a source of power, such as an AC or DC power supply. While pins 22 are shown, the pins may be replaced by, for example, an Edison type base for connection to an Edison socket. Other electrical connectors may be used to provide power to the lamp in other applications.

The enclosure 2 has a mounting portion 2*a* that functions to connect the enclosure 2 to the other components of the lamp and a connector portion 2*b* that, with the pins or other electrical connector, connects the lamp to the power source. The connector portion 2*b* may have any shape that allows an electrical and/or physical connection to be made between the lamp and the power source. The mounting portion 2*a* comprises an outer wall 26 that mates with a cooperating structure on the heat sink 8 and that forms a support surface for the heat sink in the assembled lamp. While the mounting portion 2*a* is shown as having an annular wall 26, the enclosure 2 and mating structure on the heat sink 8 may be of a variety of shapes and sizes. A transition area 2*c* connects the mounting portion 2*a* to the connector portion 2*b* to complete the enclosure 2. The enclosure 2 may be formed as a single piece or it may be formed of plural pieces that are connected together.

The enclosure 2 also comprises a flange 28 disposed about the exterior periphery of the enclosure that is engaged by the heat sink 8 to secure the heat sink 8 to the enclosure 2 as will be described. In one embodiment, the flange 28 has a first face 30 that faces toward the heat sink 8 and that extends generally perpendicular to the surface of outer wall 26 of the mounting portion 2*a*. The flange 28 also comprises a second face 32 that extends toward the connector portion 2*b* and that is disposed at an acute angle relative to the surface of outer wall 26 of the mounting portion 2*a* to create a tapered surface. The first face 30 and second face 32 may be connected by a lateral face 34. The second face 32 extends between the lateral face 34 and the wall 26 to create a tapered flange where face 32 is disposed at an oblique angle relative to the wall 26. In the illustrated embodiment the flange 28 extends uninterrupted for the entire periphery of the enclosure 2; however, the flange 28 may comprise a plurality of spaced flanges provided that sufficient support is provided to securely attach the heat sink 8 to the enclosure 2.

The electronics 4 for the lamp are retained in the enclosure 2. In some embodiments, a driver and/or power supply are included in the enclosure. The power supply and drivers may also be mounted separately where components of the power supply are mounted in the enclosure 2 and other components are external to the lamp. The enclosure 2 may include a power supply and/or driver that form all or a portion of the electrical path between the mains and the LEDs. The enclosure may also include only part of the power supply circuitry while some smaller components reside elsewhere in the lamp. After the electronics 4 for the lamp are placed in the enclosure 2 the enclosure may be filled, or partially filled, with a potting material. The potting material may be oven cured.

Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V.

A heat sink 8 is secured to the enclosure 2 as will hereinafter be described. The heat sink 8 comprises a generally planar support 40 on which the LED assembly 10 is located. The LED assembly 10 may be secured to the support 40 using, for example, a thermal epoxy. The heat sink 8 is made of aluminum, copper, thermally conductive plastic or other thermally conductive material. A wall 48 is connected to the planar support 40 that is dimensioned to fit over the mounting portion 2*a* of the enclosure 2. In the illustrated embodiment the mounting portion 2*a* is cylindrical such that wall 48 is shaped as a ring; however, the mounting portion 2*a* and the wall 48 may have other shapes. The wall 48 has a first end 48*a* that may be disposed substantially coextensive with the support 40. The wall 48 is dimensioned such that the opposite end 48*b* of the wall 48 abuts the first face 30 of the flange 28 when the heat sink 8 is seated on the enclosure 2. When the heat sink 8 is seated on the enclosure 2, the first end 6 of the enclosure 2 abuts the inner side of the support 40, the wall 48 closely receives the mounting portion 2*a* of the enclosure 2, and the end 48*b* of the wall 48 abuts the first face 30 of the flange 28.

The wall 48 is connected to and supports a plurality of heat transfer devices that provide a relatively large surface area for transferring heat from the heat sink 8 to the ambient environment. In one embodiment the heat transfer devices comprise a plurality of fins 50 that extend radially from the wall 48. The fins 50 are relatively thin planar members that create a relatively large heat transfer surface area. The fins 50 may be connected to the wall 48 such that first outer ends 50*a* of the fins 50 extend beyond the support 40 to define a cavity 52 for receiving the LED assembly 10, lens 12 and lens shield 15. The ends 50*a* of the fins 50 are connected to a rim 54 that provides structural rigidity to the fins 50 and provides a physical connection point for retaining the components in the cavity 52.

The opposite inner ends 50*b* of the fins 50 extend beyond the inner end 48*b* of the wall 48 such that the inner ends 50*b* of the fins 50 extend over and beyond the flange 28 formed on the enclosure 2. To secure the heat sink 8 to the enclosure 2 the heat sink 8 is directly engaged with the enclosure 2. In one embodiment, the ends 50*b* of the fins 50 are bent or crimped inwardly toward the enclosure 2 to trap and clamp the flange 28. The fins 50 may be bent using a press jig such that all of the fins 50 are bent around the flange 28 in a single operation. Using a portion of the heat sink 8 to directly engage the enclosure 2 such as by clamping a portion of the enclosure 2 eliminates the need for separate fasteners, such as screws, or adhesive to secure the enclosure to the heat sink structure. The assembly process, using a press jig or similar device, to bend the fins is a simpler and more economical assembly process than is known in the art, eliminates parts and process steps and lowers the cost of manufacturing a lamp.

While in the illustrated embodiment the ends 50*b* of the fins 50 are used to clamp the heat sink 8 to the enclosure 2, the clamping portion of the heat sink may comprise elements separate from the fins. For example, the clamping portion of the heat sink may comprise separate members such as fingers that extend from the wall 48 or from the fins 50 and that are bent to clamp the flange 28.

Figure 4:
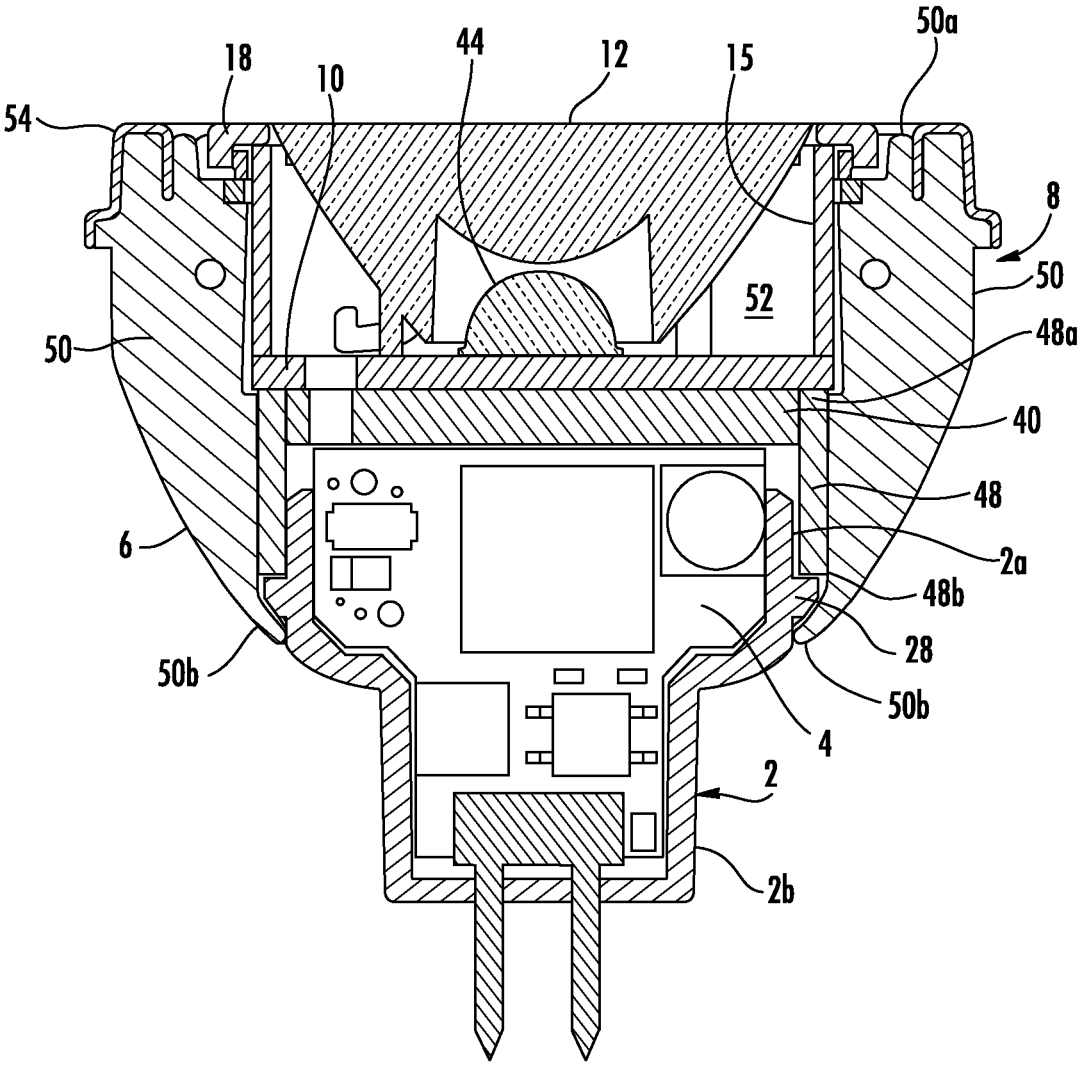
FIG. 4 is a section view taken along line 4-4 of FIG. 3.
Figure 5:
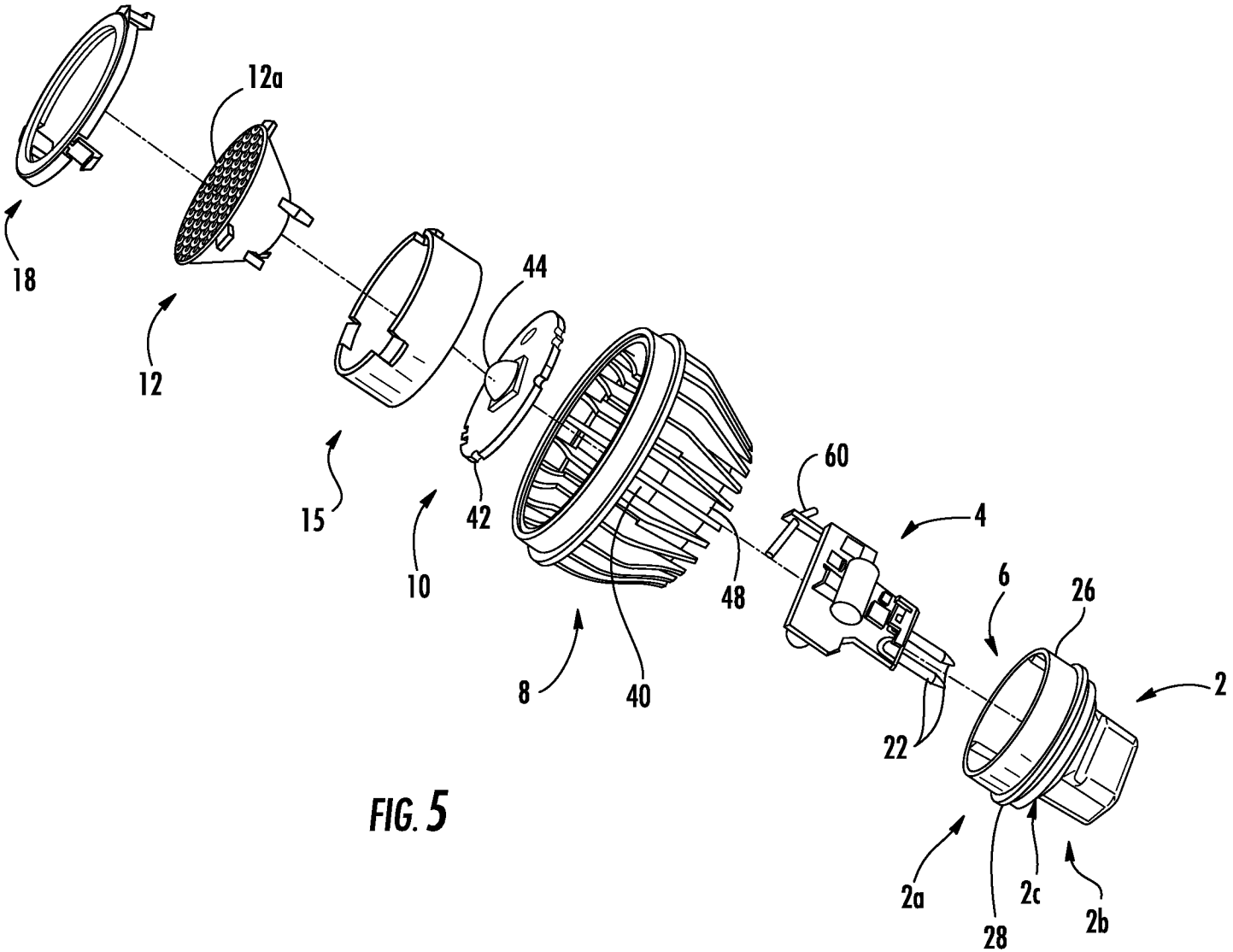
FIG. 5 is an exploded view of the lamp of FIG. 1.
Figure 8:
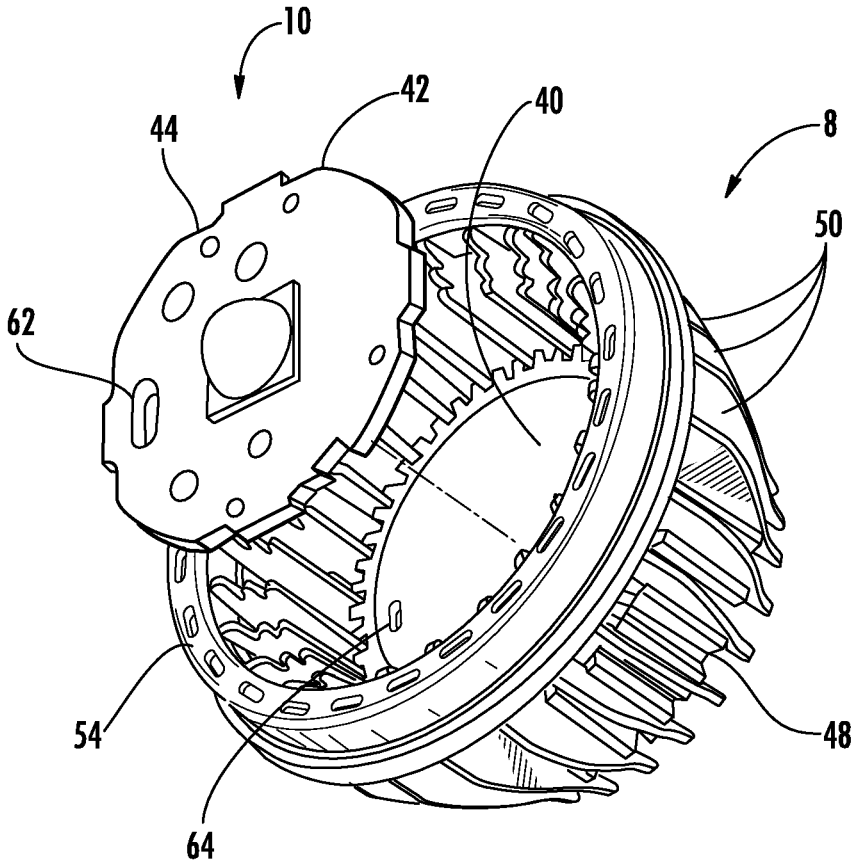

Referring to FIGS. 4, 5 and 8, the lamp further comprises an LED assembly 10 mounted on the support 40 such that the LED projects light from the lamp. LED assembly 10 may be provided with one or more light emitting LEDs, LED chips and/or LED packages (referred to herein as LED 44). LED wires 60 are extended from the electronics 4 in the enclosure 2 through apertures 62 and 64 formed in the support 40 and substrate 42 and are connected to the LED 44 to power the LED. Multiple LEDs may be used together, forming an LED array. The LEDs can be mounted on or fixed to a substrate in various ways such as board or substrate 42. In at least some example embodiments, a PCB board may be used. The LEDs may comprise an LED die disposed in an encapsulant such as silicone, and LEDs which may be encapsulated with a phosphor to provide local wavelength conversion. A wide variety of LEDs and combinations of LEDs may be used in the LED assembly 10 as described herein. The power supply and/or driver(s) that form at least part of the electronics may form all or a portion of the electrical path between the power source and the LEDs. Some embodiments of the invention can include multiple LED sets coupled in series. The power supply in some embodiments can include a plurality of current diversion circuits, respective ones of which are coupled to respective nodes of the LED sets and configured to operate responsive to bias state transitions of respective ones of the LED sets. In some embodiments, a first one of the current diversion circuits is configured to conduct current via a first one of the LED sets and is configured to be turned off responsive to current through a second one of the LED sets. The first one of the current diversion circuits may be configured to conduct current responsive to a forward biasing of the first one of the LED sets and the second one of the current diversion circuit may be configured to conduct current responsive to a forward biasing of the second one of the LED sets. With respect to the features of the LED assembly and related electronics described above, the features can be combined in various ways. For example, various types of LED arrangements such as bare die versus encapsulated or packaged LED devices may be used. The embodiments shown and described herein are examples only and are intended to be illustrative of various designs for a LED or a LED lighting system.

The LED chips can have many different semiconductor layers arranged in different ways and can emit many different colors in different embodiments according to the present invention. LED structures, features, and their fabrication and operation are generally known in the art and only briefly discussed herein. The layers of the LED chips can be fabricated using known processes with a suitable process being fabrication using metal organic chemical vapor deposition (MOCVD). The layers of the LED chips generally comprise an active layer/region sandwiched between first and second oppositely doped epitaxial layers all of which are formed successively on a growth substrate. LED chips can be formed on a wafer and then singulated for mounting in a package. It is understood that the growth substrate can remain as part of the final singulated LED or the growth substrate can be fully or partially removed. It is also understood that additional layers and elements can also be included in the LED chips including but not limited to buffer, nucleation, contact and current spreading layers as well as light extraction layers and elements. The active region and doped layers may be fabricated from different material systems, with preferred material systems being Group-III nitride based material systems. Group-III nitrides refer to those semiconductor compounds formed between nitrogen and the elements in the Group III of the periodic table, usually aluminum (Al), gallium (Ga), and indium (In). The term also refers to ternary and quaternary compounds such as aluminum gallium nitride (AlGaN) and aluminum indium gallium nitride (AlnGaN). In one embodiment, the doped layers are gallium nitride (GaN) and the active region is InGaN. In alternative embodiments the doped layers may be AlGaN, aluminum gallium arsenide (AlGaAs) or aluminum gallium indium arsenide phosphide (AlGaInAsP). The growth substrate can be made of many materials such at sapphire, silicon carbide, aluminum nitride (AlN), gallium nitride (GaN).

Referring to FIGS. 4 and 5, a lens shield 15 is retained in the cavity 52 and may be supported against the substrate 42 of the LED assembly 10. The lens shield 15 is connected to the heat sink 8 to hold the lens shield 15 in place in the cavity 52. A lens 12 is positioned in the lens shield 15 for receiving the light generated by the LED 44 and transmitting the light in a desired pattern from the lamp. The lens 12 may be a total internal reflection (TIR) lens and may comprise a light diffusing surface 12*a* for diffusing the light and mixing the light generated by the LED assembly 10. The lens shield 15 may be transparent and may be provided with a light diffusing layer to pass through any light that may laterally exit the TIR lens 12. A reflector may also be used rather than the transparent shield to reflect rather than disperse any light exiting the lens. The lens 12 may take many different forms and may project the light in a variety of patterns. A retaining ring 18 is disposed over a portion of the lens shield 15 and a portion of the lens 12 to retain the lens and lens shield in the cavity 52. The retaining ring 18 may be snap fit to the heat sink structure 8 to retain these components in the lamp.

While one embodiment of a lamp is shown herein the lamp may comprise numerous changes from that shown herein. For example, the lamp may comprise an Edison base and may be used as a replacement bulb for a A19 lamp or a PAR style lamp. Other electrical connectors may also be used. The lens may comprise a wide variety of configurations and may be designed to project the light in a wide variety of patterns for a wide variety of lighting applications. Further, the shape and configuration of the heat shield structure may vary from that shown and the shape and configuration of the fins may assume a wide variety of shapes sizes and configurations. The LED assembly 10 and LEDs 44 may comprise a wide variety of solid state lighting configurations such as those described herein and may be emit light in a wide variety of colors.

Figure 6:
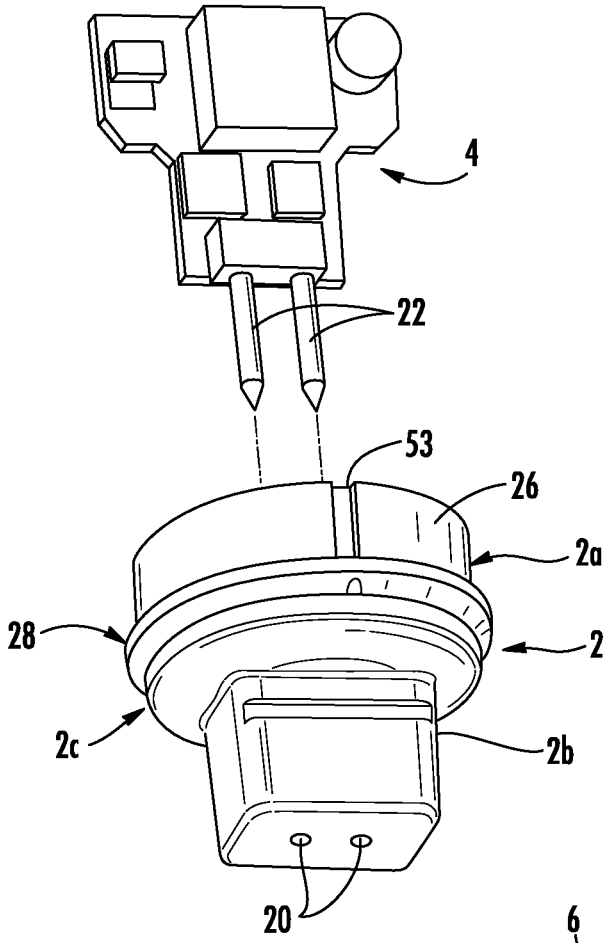
FIGS. 6 through 14 show an embodiment of a method of making the lamp of the invention.
Figure 7:
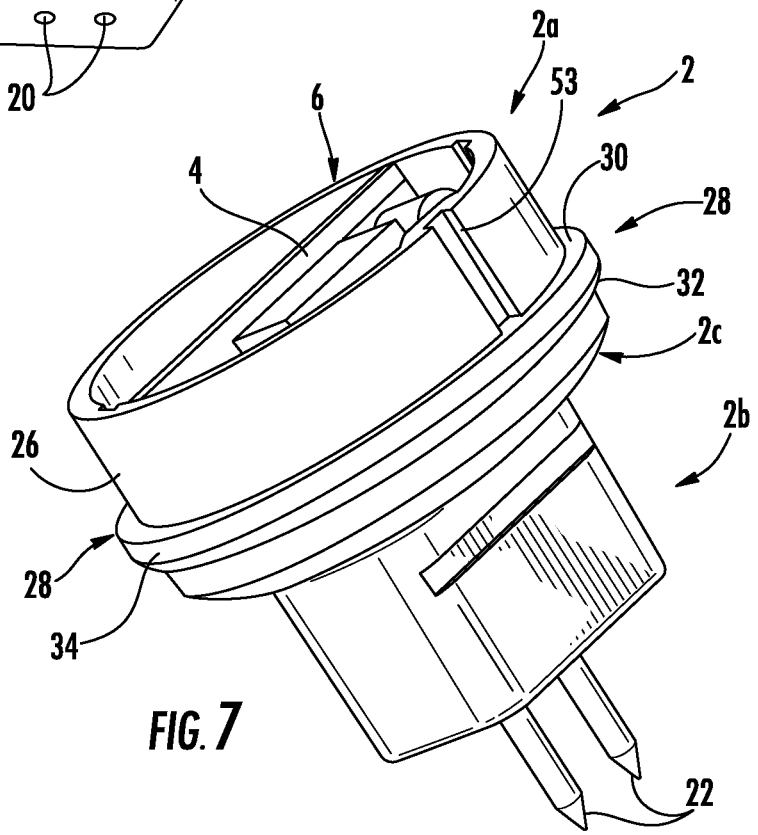

A method of making a lamp will now be described. Referring to FIGS. 6 and 7, an electronics enclosure 2 may be molded of a suitable thermally conductive and electrical insulating material such as a plastic or resin with a filler. Other materials may also be used. The enclosure 2 may assume a variety of shapes and sizes for retaining the electronics of the lamp. The enclosure 2 defines an interior space for retaining the electronics 4, a connector portion 2*b* and a mounting portion 2*a* for attachment to the heat sink structure 8. The electronics 4 are inserted into the enclosure 2 and an electrical connection is made to the lamp's electrical connector. In the illustrated embodiment, the electrical connector comprises pins 22 and forms part of the electronics 4 and is inserted through holes 20 formed in the enclosure 2 such that the pins 22 are exposed. Alternatively, the electrical connector may be formed as part of the enclosure 2 such as an Edison style connector secured to the enclosure by adhesive, mechanical connection or the like. With a separate electrical connector, such as an Edison connector, wires or other electrical connectors connect the electronics to the connector. In some embodiments, such as with an Edison connector the connector may form part of the enclosure 2 such that some or all of the electronics 4 are contained in the connector. After the electronics 4 are located in the enclosure 2 a potting material may fill or partially fill the enclosure to isolate the electronics from the external environment and provide shock resistance, moisture control, electrical isolation and the like. The subassembly may be heated in an oven to cure the potting material.

Referring to FIG. 8, the heat sink 8 is made of aluminum, copper, thermally conductive plastic or other thermally conductive material. The heat sink 8 may be molded, extruded or assembled from individual components. The LED assembly 10 is placed onto and secured to support 40. In one embodiment, a thermal epoxy or other adhesive may be dispensed on the support 40. The heat sink 8 and LED assembly 10 may be heated to cure the thermal epoxy.

Figure 9:
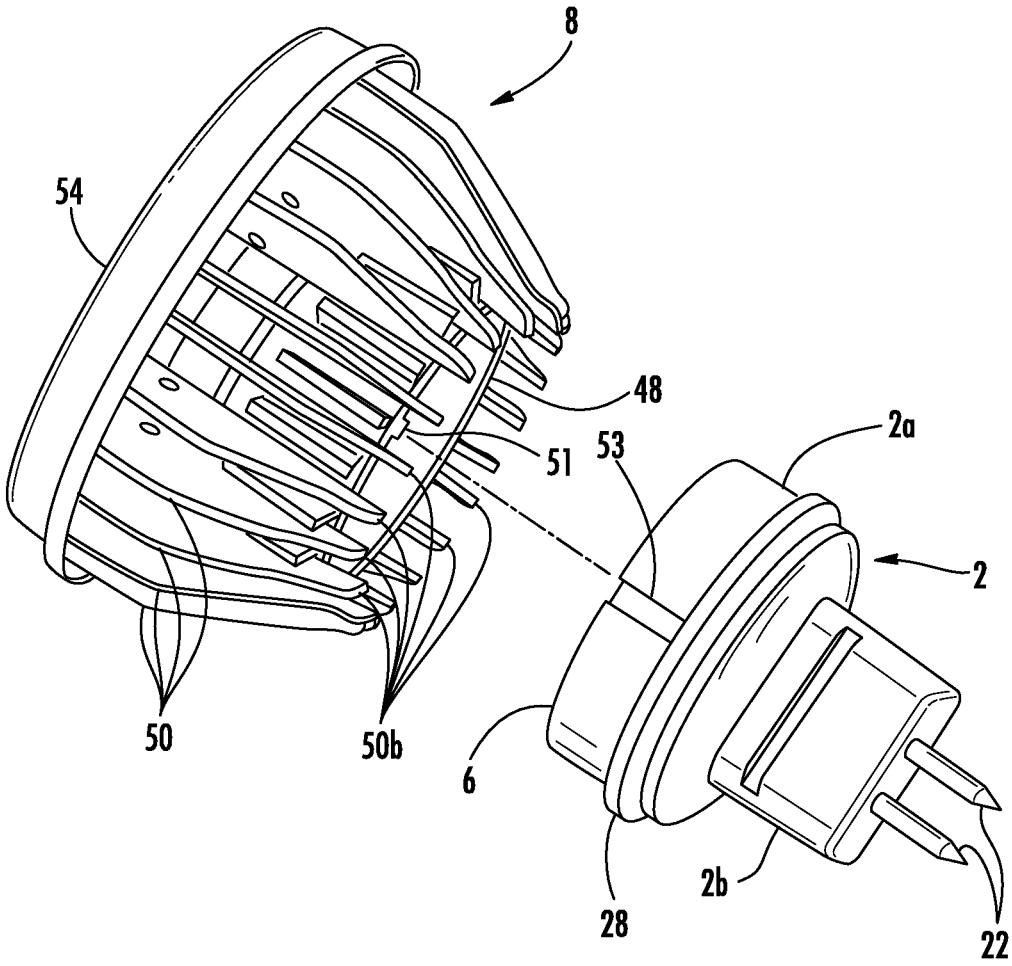

Referring to FIG. 9, the heat sink 8 is then assembled to the enclosure 2. The mounting portion 2*a* is inserted into wall 48 such that the support 40 of the heat sink 8 abuts the end 6 of the mounting portion 2*a* and the heat sink 8 is seated on the enclosure 2. The wall 48 closely receives the mounting portion 2*a* of the enclosure 2 and the end 48*b* of the wall 48 abuts the first face 30 of the flange 28. An alignment key 51 on one of the enclosure 2 and heat sink 8 may mate with an alignment keyway 53 on the other of the enclosure 2 and heat sink 8 to properly align the enclosure 2 with the heat sink 8.

Figure 10:
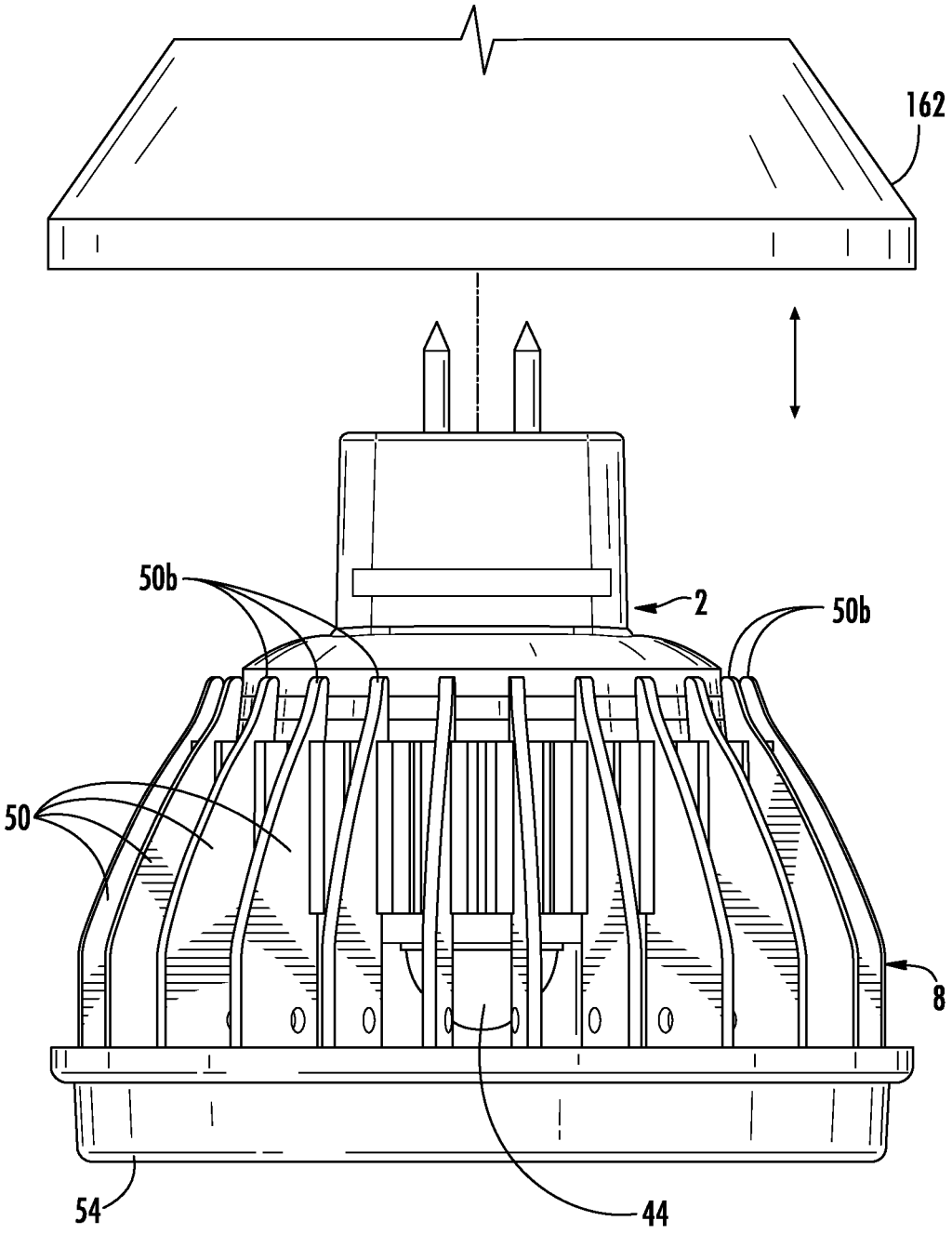

Referring to FIG. 10, once the heat sink 8 is properly seated on the enclosure 2, the heat sink 8 is secured to the enclosure 2 using a direct engagement between the heat sink and the enclosure. The terms "direct engagement" and/or "directly engaging" as used herein means that the heat sink engages and is secured to the enclosure without the use of a separate attachment mechanism (e.g. adhesive, screws, soldering or the like) such that the physical engagement of the heat sink with the enclosure effectuates the attachment of these components. In one embodiment, the fins 50 or other clamping portions of the heat sink 8 are bent or crimped to clamp the flange 28 on the enclosure 2 and secure the enclosure 2 to the heat sink 8. A press jig 162 may be used to bend or crimp the ends of the fins 50 or other clamping portions of the heat sink 8 in a single operation such that the fins 50 or other clamping portions of the heat sink 8 trap the flange 28 between the fins 50 other clamping portions of the heat sink 8 and the wall 48. The press jig 162 is pressed against the ends of the fins 50 other clamping portions of the heat sink 8 with sufficient clamping force to bend the ends 50*b* of the fins 50 other clamping portions of the heat sink 8 to secure the enclosure 2 to the heat sink 8. A sufficient clamping force is created to secure the enclosure to the heat sink to comply with UL standards for lamps and light bulbs. Using the clamping arrangement allows the heat sink 8 to be attached to the enclosure 2 in a single simple jig press operation, or similar operation, and eliminates the need for additional components such as separate fasteners or adhesive. Further, the clamping arrangement makes it difficult for the user to separate the heat sink 8 from the enclosure 2 after assembly.

Wires or other electrical connectors 60 may be extended through the apertures 62, 64 formed in the support 40 and LED assembly 10 and be connected, such as by soldering, to the LED assembly 10 to complete the electrical path from electronics 4 to the LEDs.

Figure 11:
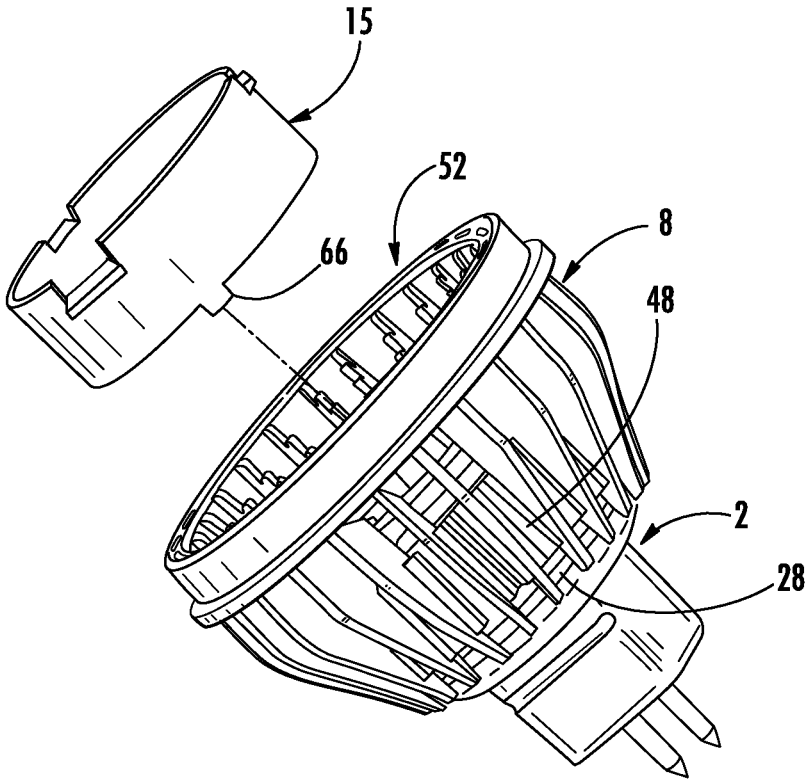
Figure 12:
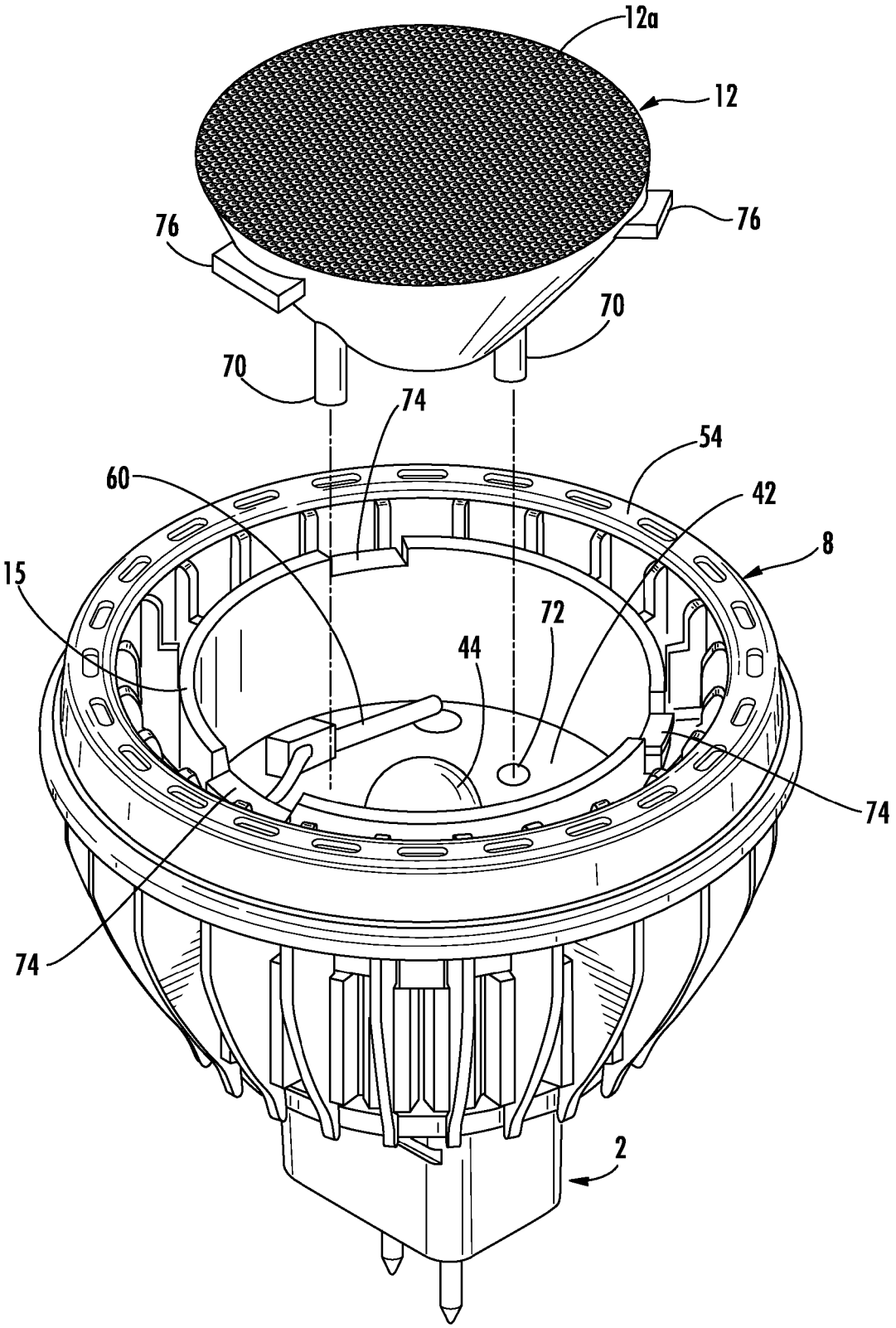
Figure 13:
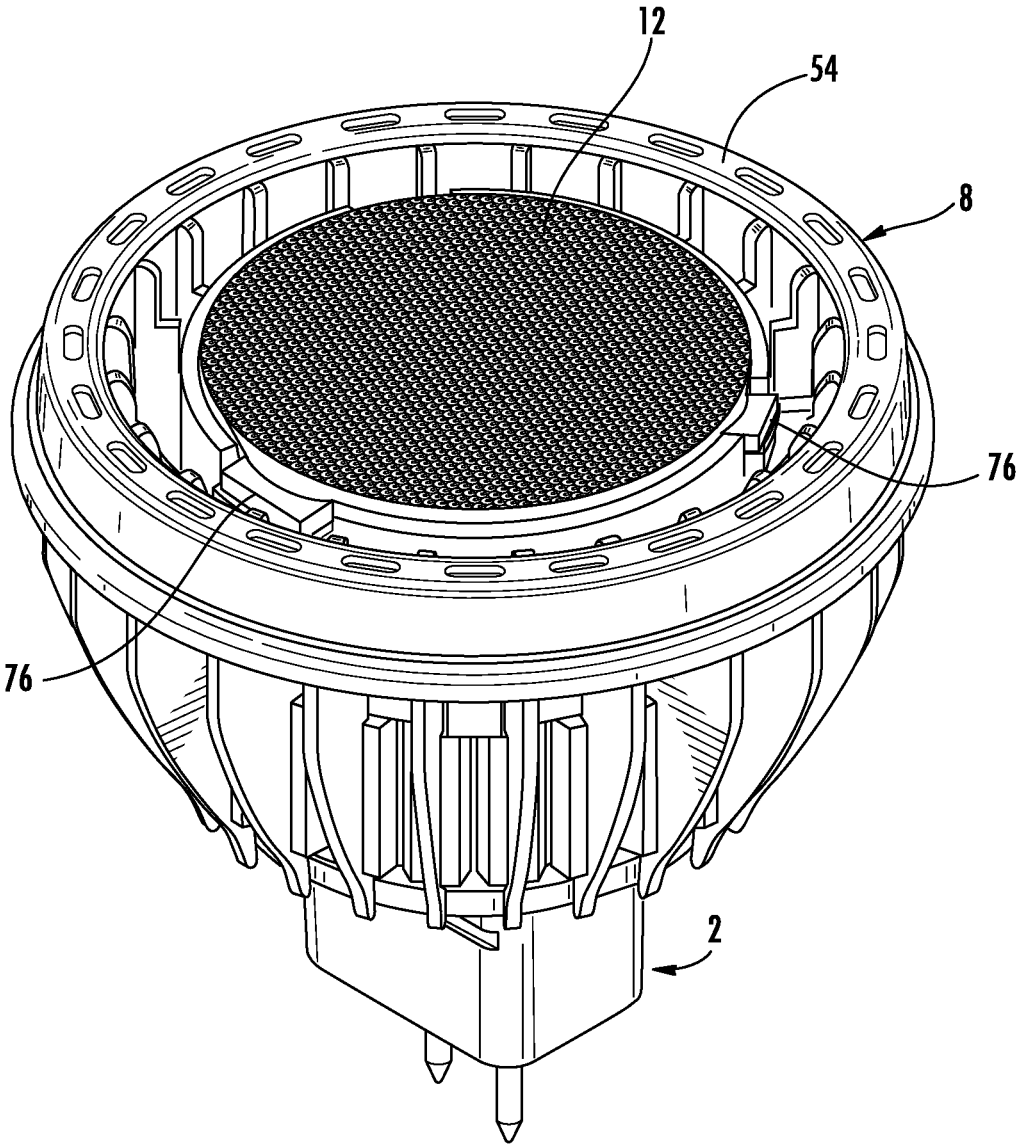

Referring to FIG. 11, the lens shield 15 is then inserted into the cavity 52 in the heat sink 8 such that it surrounds, or substantially surrounds, the LED assembly 10. Keys 66 on one of the lens shield 15 or substrate 42 may be inserted into keyways 68 in the other of the lens shield or substrate to ensure the proper seating of the lens shield in the lamp. Referring to FIGS. 12 and 13 the lens 12 is then inserted into the cavity 52 and may be disposed inside of the lens shield 15. Keys 70 on one of the lens 12 or substrate 42 may be inserted into keyways 72 in the other of the lens and substrate to ensure the proper seating of the lens in the lamp. The lens shield 15 includes tabs or notches 74 that receive mating tabs 76 formed on the lens 12 such that when the lens 12 and lens shield 15 are properly oriented relative to one another the tabs or notches 74 are engaged by the tabs 76. In one embodiment, the tabs 76 of the lens 12 sit on top of the tabs or notches 74 of the lens shield 15. These cooperating elements are also used to secure the lens 12 and lens 15 shield in the lamp as will hereinafter be described.

Figure 14:
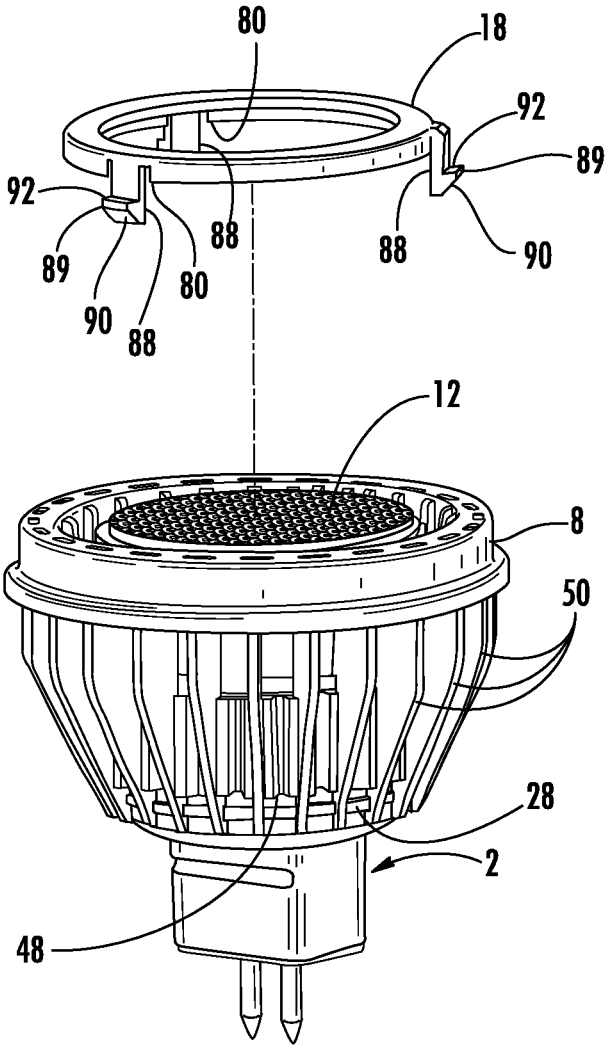

Referring to FIG. 14, a retaining ring 18 is then fixed to the heat sink 8 to secure the lens 12 and lens shield 15 in the lamp. The retaining ring 18 is dimensioned to fit over the periphery of the lens 12 and may include notches or cut outs 80 that receive the tabs 74, 76 formed on the lens 12 and the lens shield 15. The retaining ring 18 also comprises a plurality of locking tabs or fingers 88. The fingers 88 flex relative to the ring 18 and comprise locking members 89 formed with camming surfaces 90 and locking faces 92. The ring 18 is inserted into the heat sink 8 such that the camming surfaces 90 abut a surface of the annular rim 54 such that the fingers 88 are flexed to an unlocked position. The ring 18 is seated on the lens 14 with the tabs 74 and 76 of the lens and lens shield positioned in the notches 80 formed on the underside of the ring 18. As the ring 18 reaches the fully seated position, the locking members 89 pass beyond the mating locking surface on the rim 54 such that the resiliency of the material of the fingers 88 cause the fingers 88 to return to the undeflected locked position where the locking members 89 are disposed behind the rim 54. The engagement of the locking faces 92 of locking members 89 with the rim 54 fixes the retaining ring 18 to the heat sink structure 8 and clamps the lens 12 and lens shield 15 in position against the LED assembly 10.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An LED device comprising:

an LED for emitting light, and electronics for powering the LED;

an enclosure for retaining at least a portion of the electronics and a flange formed on the enclosure;

a heat sink for dissipating heat from the LED, the heat sink comprising a wall having an end that abuts a first face of the flange and a portion that extends over the flange and is permanently bent to engage a second face of the flange such that the flange is between the end of the wall of the heat sink and the portion of the heat sink to secure the heat sink structure to the enclosure.

2. The LED device of claim 1 wherein a lens is supported on the heat sink to receive the light.

3. The LED device of claim 1 wherein the flange extends outwardly from a wall of the enclosure.

4. The LED device of claim 3 wherein the wall of the enclosure engages the wall of the heat sink.

5. The LED device of claim 3 wherein the portion of the heat sink engages a first surface of the flange, the first surface of the flange extending at an oblique angle relative to the wall of the enclosure.

6. The LED device of claim 5 wherein the wall of the heat sink abuts a second surface of the flange.

7. The LED device of claim 1 wherein the heat sink comprises fins, the portion of the heat sink being formed by a first end of the fins.

8. The LED device of claim 7 wherein the flange is formed on a wall of the enclosure, a first surface of the flange extending at an oblique angle relative to the wall and the fins engaging the surface of the flange.

9. The LED device of claim 7 wherein the fins define a cavity for receiving the LED.

10. The LED device of claim 9 wherein a lens is retained in the cavity by a retaining member that is connected to the fins.

11. A method of making a lamp comprising:

providing an LED for emitting light, supporting the LED on a heat sink;

providing electronics for powering the LED;

supporting at least a portion of the electronics in an enclosure;

mounting the heat sink on the enclosure; and permanently deforming a portion of the heat sink after the heat sink is mounted on the enclosure to clamp the enclosure to secure the heat sink to the enclosure.

12. The method of claim 11 wherein the step of deforming comprises bending the portion of the heat sink into engagement with a portion of the enclosure.

13. The method of claim 12 wherein the portion of the enclosure comprises a flange formed on an outer surface of the enclosure, the portion of the heat sink engaging the flange.

14. The method of claim 11 wherein the step of deforming comprises bending a plurality of fins of the heat sink into engagement with the enclosure.

15. The method of claim 11 wherein the step of deforming comprises bending a plurality of fins of the heat sink into engagement with the enclosure in a single operation.

16. The method of claim 11 wherein the step of deforming comprises bending a plurality of fins of the heat sink into engagement with the enclosure using a press jig.

17. The method of claim 11 further comprising securing an electrical connector to the enclosure.

18. An LED device comprising:

an LED for emitting light, and electronics for powering the LED;

an enclosure for retaining at least a portion of the electronics;

a heat sink for dissipating heat from the LED comprising a first portion for engaging the enclosure and a second portion permanently bent to engage a flange formed on the enclosure such that the enclosure is clamped between the first portion and the second portion to secure the heat sink to the enclosure.

19. The LED device of claim 18 wherein the flange extends from a wall of the enclosure.

20. The LED device of claim 18 wherein the first portion of the heat sink abuts the flange.

21. The LED device of claim 18 wherein the second portion of the heat sink comprises fins, the fins clamping the enclosure to secure the heat sink structure to the enclosure.

22. The LED device of claim 21 wherein the fins define a cavity for receiving the LED.

* * * * *